US005260185A

United States Patent [19]

Takabayashi et al.

[11] Patent Number: 5,260,185

[45] Date of Patent: Nov. 9, 1993

[54] CONCENTRATED COLOR DEVELOPER COMPOSITION FOR SILVER HALIDE PHOTOGRAPHIC LIGHT-SENSITIVE MATERIALS

[75] Inventors: Naoki Takabayashi; Mitsuhiko Uno; Masaaki Furuya, all of Hino, Japan

[73] Assignee: Konica Corporation, Tokyo, Japan

[21] Appl. No.: 928,872

[22] Filed: Aug. 11, 1992

[30] Foreign Application Priority Data

Aug. 20, 1991 [JP] Japan ..... 3-232282

[51] Int. Cl.[5] ..... G03C 7/30

[52] U.S. Cl. ..... 430/491; 430/484; 430/485; 430/486; 430/490

[58] Field of Search ..... 430/484, 485, 486, 490, 430/491, 492

[56] References Cited

U.S. PATENT DOCUMENTS

| | | | |
|---|---|---|---|
| 4,837,139 | 6/1989 | Kobayashi et al. | 430/490 |
| 4,948,713 | 8/1990 | Kobayashi | 430/484 |
| 4,985,347 | 1/1991 | Fujimoto et al. | 430/491 |
| 5,053,322 | 10/1991 | Shiba et al. | 430/484 |
| 5,153,111 | 10/1992 | Yoshida et al. | 430/484 |

FOREIGN PATENT DOCUMENTS

| | | |
|---|---|---|
| 0343557 | 11/1989 | European Pat. Off. . |
| 2-096749 | 4/1990 | Japan . |

*Primary Examiner*—Hoa Van Le

*Attorney, Agent, or Firm*—Frishauf, Holtz, Goodman & Woodward

[57] ABSTRACT

A concentrated composition of color developer for silver halide color photographic light-sensitive material is disclosed. The composition is excellent in stability during storage for a long period. The composition comprises a specified hydroxyamine derivative and a specific chelating agent. The composition preferably has a pH value of not lower than 10.6.

4 Claims, No Drawings

CONCENTRATED COLOR DEVELOPER COMPOSITION FOR SILVER HALIDE PHOTOGRAPHIC LIGHT-SENSITIVE MATERIALS

FIELD OF THE INVENTION

The present invention relates to a concentrated color developer composition for silver halide color photographic light-sensitive materials, and more particularly to a concentrated color developer solution composition which can be stably stored over an extensive period of time.

BACKGROUND OF THE INVENTION

A color developer is lately provided as a concentrated solution product or powdery product in a unit of a plurality of separated parts packed in a kit form in order to reduce its weight or bulk in transport or from the viewpoint of its preservability.

The parts of the color developer kit are dissolved or diluted in water to be used as a color developer solution or as a color developer replenisher in an actual processing operation.

However, certain chemicals that constitute the kit have a problem that, even when stored as members of the kit, if the storage period is prolonged, when processing is made in a processing solution prepared by dissolving the kit, the chemicals may be unable to provide any expected characteristics.

On the other hand, with the recent prevalence of a minilab processing system, technological improvement of processors and associated equipment used therefor have been developed, particularly for an automated print-making process. For this reason, there are increasing cases where unskilled operators, such as part-timers having no expertize, are employed for the processing work, which result in lowering of printing yield.

The use of a color developer solution that is unable to provide any intended characteristics or kits different in the storage period brings about a badly loss of printing yield because of the difference in its developability, leading to inconsistent printing levels. Such a loss of the printing yield is of a vital importance affecting the very existence of the photofinisher.

Incidentally, with the recent tendency of shortening the photographic processing time or using less replenishment of processing solutions there has arisen a demand for a more concentrated kit than the conventional ones and long-term preservability improvement.

It has been found, however, that even such a highly concentrated kit still has a problem in its preservability and is unable to provide stable photographic characteristics. For example, where the kit is stored during summer or transported across the equator, a preservative contained in the kit becomes badly deteriorated and, when used for processing, produce very unstable photographic characteristics.

Accordingly, in respect of a concentrated color developer composition containing a preservative, there is a demand for developing a technique to provide stable photographic processability.

SUMMARY OF THE INVENTION

It is an object of the present invention to provide a specific preservative-containing concentrated color developer composition for silver halide color photographic light-sensitive materials which, even after being stored in the form of a kit over a long period of time, is capable of providing stable photographic characteristics.

The above object of the invention is accomplished by a concentrated composition of color developer for developing a silver halide color photographic light-sensitive material comprising a compound represented by the following formula A, B or C in concentration of not lower than 125 g/l and a compound represented by the following formula K-I, K-II or K-III:

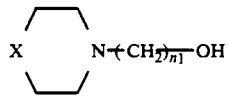

(A)

wherein X is an oxygen atom or a $R_1$—N< group, $R_1$ is a hydrogen atom, a hydroxyl group or an alkyl group having 1 or 2 carbon atoms which may have a substituent; and $n_1$ is an integer of 0, 1 or 2.

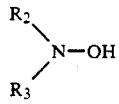

(B)

wherein $R_2$ and $R_3$ are each a hydrogen atom or a an alkyl group having 1 to 5 carbon atoms which may be substituted with an alkoxy group, a sulfonic acid group, a phosphoric acid group, a carboxyl group or an ammonium group, provided that at least one of $R_2$ and $R_3$ is the substituted or unsubstituted alkyl group,

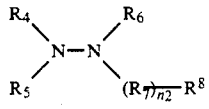

(C)

wherein $R_4$, $R_5$ and $R_6$ are each a hydrogen atom, a substituted or unsubstituted alkyl group, a substituted or unsubstituted aryl group or a substituted or unsubstituted heterocyclic group; $R_8$ is a hydroxy group, a hydroxyamino group, a substituted or unsubstituted alkyl group, a substituted or unsubstituted aryl group, a substituted or unsubstituted heterocyclic group, a substituted or unsubstituted alkoxy group, a substituted or unsubstituted aryloxy group, a substituted or unsubstituted carbamoyl group or a substituted or unsubstituted amino group; $R_7$ is a —CO— group, a —$SO_2$— group or a >C=NH group; and $n_2$ is an integer of 0 or 1;

A—COOM (K-I)

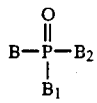

(K-II)

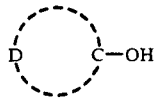

(K-III)

wherein A, B, $B_1$ and $B_2$ are each a monovalent atom or group; D is a group of atoms necessary to form an aromatic or heterocyclic ring; and M is a hydrogen atom or an alkali metal atom.

In a preferable embodiment of the invention, the concentrated composition has a pH value of not lower than 10.6.

DETAILED DESCRIPTION OF THE INVENTION

Compounds represented by the foregoing Formulas A, B and C are detailed below. Examples of the compounds represented by Formula A are shown below:

| | X | n |
|---|---|---|
| A-1 | H—M | 0 |
| A-2 | $HOCH_2CH_2$—N | 0 |
| A-3 | O | 0 |
| A-4 | $CH_3$—N | 0 |
| A-5 | HO—N | 0 |
| A-6 | O | 2 |
| A-7 | HO—N | 2 |
| A-8 | $C_3H_6$—N | 1 |
| A-9 | HOOC—$CH_2CH_2$—N | 0 |
| A-10 | $HO_2S$—$CH_2CH_2$—N | 0 |
| A-11 | $H_2O_3P$—$CH_2$—N | 0 |

These compounds represented by Formula A may be used in the form of salts, such as sulfates, chlorides, exalates, phosphates or nitrates.

The following are examples of the compounds represented by Formula B, but are not limited thereto.

| | $R_2$ | $R_3$ |
|---|---|---|
| B-1 | $CH_3OC_2H_4$— | $CH_3$— |
| B-2 | $CH_3OC_2H_4$— | $C_2H_5$— |
| B-3 | $CH_3OC_2H_4$— | $CH_3OC_2H_4$— |
| B-4 | $C_2H_5OC_2H_4$— | $C_2H_5OC_2H_4$— |
| B-5 | $CH_3OC_3H_6$— | $CH_3OC_3H_6$— |
| B-6 | $C_2H_5OC_2H_4$— | $C_2H_5$— |
| B-7 | $CH_3OC_2H_4$— | $C_3H_7$— |
| B-8 | $C_2H_5OC_2H_4$— | $CH_3$— |
| B-9 | $CH_3OCH_2$— | $CH_3$— |
| B-10 | $C_2H_5OCH_2$— | $C_2H_5$— |
| B-11 | $CH_3OCH_2$— | $CH_3OCH_2$— |
| B-12 | $C_3H_7OC_2H_4$— | $C_2H_5$— |
| B-13 | $C_3H_7OC_3H_6$— | $C_3H_7OC_3H_6$— |
| B-14 | —$CH_2CH_2COOH$ | —$CH_2CH_2COOH$ |
| B-15 | —$CH_2CH_2SO_3H$ | —$CH_2CH_2SO_3H$ |
| B-16 | —$CH_2PO_3H_2$ | —$CH_2PO_3H_2$ |
| B-17 | —$CH_2CH_2PO_3H_2$ | —$CH_2CH_2PO_3H_2$ |
| B-18 | —$CH_2CH_2CH_2SO_3H$ | —H |
| B-19 | HO—$CH_2CH_2OCH_2CH_2$— | HO—$CH_2CH_2OCH_2CH_2$— |
| B-20 | —$CH_2CH_2N^{\oplus}(CH_3)_3$ | —$CH_2CH_2N^{\oplus}(CH_3)_3.SO_4^{2\ominus}$ |
| B-21 | —H | —$CH(CH_3)_3CH_2COOH$ |
| B-22 | —$CH_2CH_2SO_3^{\ominus}$ | —$CH_2CH_2N^{\oplus}(CH_3)_5$ |
| B-23 | —$C_2H_5$ | —$C_2H_5$ |

These compounds represented by Formula B may be used normally in the form of free amines, chlorides, sulfates, p-toluenesulfonates, oxalates or acetates.

The following are examples of the compounds represented by Formula C.

| | $R_4$ | $R_5$ | $R_6$ | $R_7$ | n | $R_8$ |
|---|---|---|---|---|---|---|
| C-1 | H | H | —$C_2H_5$ | — | 0 | —$C_2H_5$ |
| C-2 | H | H | H | — | 0 | $\leftarrow CH_2 \rightarrow_4 SO_3H$ |
| C-3 | H | H | H | — | 0 | $\leftarrow CH_2 \rightarrow_2 OH$ |
| C-4 | H | H | —$C_2H_4OH$ | — | 0 | —$C_2H_4OH$ |
| C-5 | H | H | H | —CO— | 1 | —$CH_3$ |
| C-6 | H | H | H | —CO— | 1 | —$OC_2H_5$ |
| C-7 | H | H | H | —CO— | 1 | 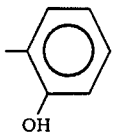 |
| C-8 | H | H | H | — | 1 | 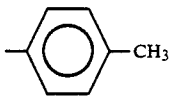 |
| C-9 | H | H | H | —CO— | 1 | —$NH_2$ |
| C-10 | H | H | H | —CO— | 1 | 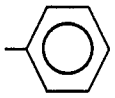 |
| C-11 | H | H | H | — | 0 | —$SO_3H$ |
| C-12 | H | H | H | — | 0 | $-CH(NH_2)-NH_2$ |
| C-13 | H | H | H | —CO— | 1 | —$CONHNH_2$ |
| C-14 | H | H | H | — | 0 | $\leftarrow CH_2 \rightarrow_3 SO_3H$ |

-continued

| | $R_4$ | $R_5$ | $R_6$ | $R_7$ | n | $R_8$ |
|---|---|---|---|---|---|---|
| C-15 | H | H | H | — | 0 | 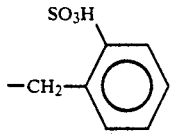 |
| C-16 | H | H | H | — | 0 | $-CH(C_4H_9(n))COOH$ |
| C-17 | H | H | H | — | 0 | $\leftarrow CH_2 \rightarrow_2 COOH$ |
| C-18 | H | H | $-CH_2COOH$ | — | 0 | $CH_2COOH$ |
| C-19 | H | H | $\leftarrow CH_2 \rightarrow_3 SO_3H$ | — | 0 | $\leftarrow CH_2 \rightarrow_8 SO_8H$ |
| C-20 | H | H | H | — | 0 | 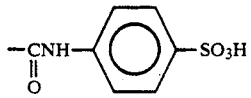 |
| C-21 | H | H | H | — | 0 | 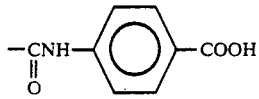 |
| C-22 | H | $HOOC-CH_2-$ | $-CH_2COOH$ | — | 0 | $-CH_2COOH$ |
| C-23 | $HOOC-CH_2-$ | $HOOC-CH_2-$ | $-CH_2COOH$ | — | 0 | $-CH_2COOH$ |
| C-24 | H | H | $-CH_2PO_3H_2$ | — | 0 | $-CH_2PO_3H_2$ |
| C-25 | H | $HOOC-CH_2-$ | H | — | 0 | $-CH_2COOH$ |
| C-26 | H | H | $-CH_2CH_2OH$ | — | 0 | $-CH_2COOH$ |
| C-27 | H | H | $(CH_2)_2-COOH$ | — | 0 | $\leftarrow CH_2 \rightarrow_2 COOH$ |
| C-28 | H | H | H | — | 0 | $-CH(C_6H_{13}(n))COOH$ |
| C-29 | H | H | $-CH(C_4H_9(n))COOH$ | — | 0 | $-CH(C_4H_9(n))COOH$ |
| C-30 | H | H | $-CH_2CH_2SO_3H$ | — | 0 | $-CH_2CH_2SO_3H$ |
| C-31 | H | H | $-CH(C_2H_5)COOH$ | — | 0 | $-CH(C_2H_5)COOH$ |
| C-32 | 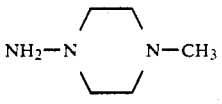 | | | | | |
| C-33 | $\leftarrow CH_2-N(NH_2)-CH_2CH_2 \rightarrow_n$ Average molecular weight: about 4,000 | | | | | |

The compounds represented by Formula C may be used normally in the form of free amines, chlorides, sulfates, p-toluenesulfonates, oxalates, phosphates or acetates.

The using amount of the above compounds represented by Formulas A, B and C is not less than 125 g, preferably not less than 150 g, more preferably not less than 200 g, and most preferably 250 g to 500 g per liter of a concentrated composition of color developer.

The particularly preferred among the above compounds of Formulas A, B and C are A-3, B-3, B-14, B-15, B-16, B-17B-18, B-23, C-3, C-18 and C-24, and the most useful for the invention is B-23.

The compounds represented by Formulas A, B and C may be used alone or in combination.

The compounds represented by the foregoing Formulas K-I, K-II and K-III (chelating agents) used in the invention are explained.

In the invention, the preferred among the chelating agents represented by Formulas K-I, K-II and K-III are the compounds represented by the following Formulas K-IV to K-XV:

$M_mP_mO_{3m}$ Formula K-IV $M_{n+2}P_nO_{3n+1}$ Formula K-V $A_1—R_1—Z—R_2—COOH$ Formula K-VI Formula K-VII

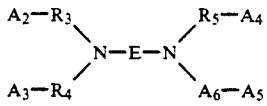

wherein E represents a substituted or unsubstituted alkylene group, a cycloalkylene group, a phenylene group, $—R_7—OR_7—$, $—R_7—OR_7OR_7—$, or $—R_7Z-R_7—$; Z is $>N—R_7—A_6$ or $>N—A_6$; $R_1$ to $R_7$ each represent a substituted or unsubstituted alkylene group; $A_1$ to $A_6$ each represent a hydrogen atom, —OH, —COOM, $—PO_3M_2$; M is a hydrogen atom or an alkali metal; m is an integer of 3 to 6; and n is an integer of 2 to 20.

$R_8N(CH_2PO_3M_2)_2$ Formula K-VIII wherein $R_8$ is a substituted or unsubstituted alkyl group having 1 or 2 carbon atoms, an aryl group, an aralkyl group or a nitrogen-containing 6-member cyclic group, the substituent to which is —OH, —OR or —COOM; and M represents a hydrogen atom or an alkali metal atom such as Na or K.

Formula K-IX

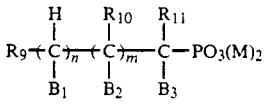

wherein $R_9$ to $R_{11}$ each represent a hydrogen atom, —OH, a substituted or unsubstituted alkyl group having 1 or 2 carbon atoms, the substituent to which is —OH, —COOM or $—PO_3—M_2$; $B_1$ to $B_3$ each represent a hydrogen atom, —OH, —COOM, $—PO_3M_3$ or $—Nj_2$, wherein j is a hydrogen atom, an alkyl group having 1 or 2 carbon atoms, $—C_2H_4OH$ or $—PO_3M_2$ and M is a hydrogen atom or an alkali metal atom; and n and m each represent an integer of 0 or 1.

Formula K-X

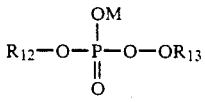

wherein $R_{12}$ and $R_{13}$ each represent a hydrogen atom, an alkali metal atom, an alkyl group having 1 to 12 carbon atoms, an alkenyl group or a cycloalkyl group.

Formula K-XI

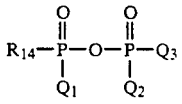

wherein $R_{14}$ represents an alkyl group having 1 to 12 carbon atoms, an alkoxy group having 1 to 12 carbon atoms, a monoalkylamino group having 1 to 12 carbon atoms, a dialkylamino group having 2 to 12 carbon atoms, an amino group, an aryloxy group having 6 to 24 carbon atoms, an arylamino group having 6 to 24 carbon atoms, or an amyloxy group: $Q_1$ to $Q_3$ each represent —OH, an alkoxy group having 1 to 24 carbon atom an aralkyloxy group, an aryloxy group, $—OM_3$ (wherein M is a cation), an amino group, a morpholino group, a cyclic amino group, a dialkylamino group, an arylamino group or an alkyloxy group.

Formula K-XII

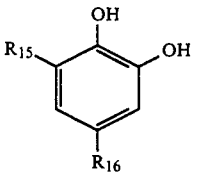

Formula K-XIII

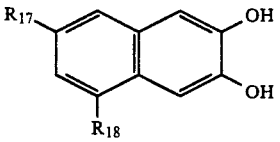

wherein $R_{15}$, $R_{16}$, $R_{17}$ and $R_{18}$ each represent a hydrogen atom, a halogen atom, a sulfo group, a substituted or unsubstituted alkyl group having 1 to 7 carbon atoms, $—OR_{19}$, $—COOR_{20}$,

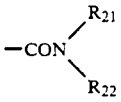

or a substituted or unsubstituted phenyl group; and $R_{19}$, $R_{20}$, $R_{21}$ and $R_{22}$ each represent a hydrogen atom or an alkyl group having 1 to 18 carbon atoms.

Formula K-XIV

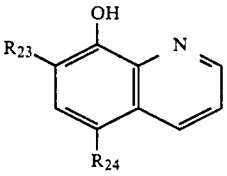

wherein $R_{23}$ and $R_{24}$ each represent a hydrogen atom, a halogen atom or a sulfo group.

Formula K-XV

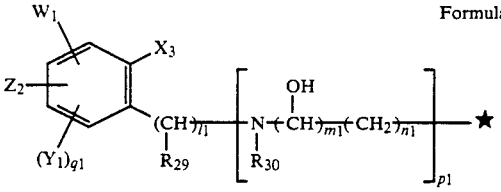

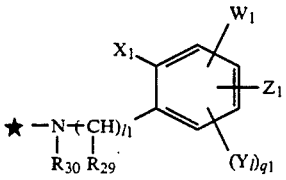

wherein $R_{29}$ and $R_{30}$ each represent a hydrogen atom, a phosphoric group, a carboxyl group, $—CH_2COOH$, $—CH_2PO_3H_2$ or a salt thereof; $X_1$ is a hydroxyl group or a salt thereof; $W_1$, $Z_1$ and $Y_1$ each represent a hydrogen atom, a halogen atom, a hydroxyl group, a cyano group, a carboxyl group, a phosphoric group, a sulfo group, or salt thereof, an alkoxy group, or an alkyl group; $m_1$ is an integer of 0 to 1; $n_1$ is an integer of 1 to 4; $l_1$ is an integer of 1 to 2; $p_1$ is an integer of 0 to 3; and $q_1$ is an integer of 0 to 2.

Examples of the chelating agents represented by Formulas K-IV to K-XV are as follows:

(K-1)

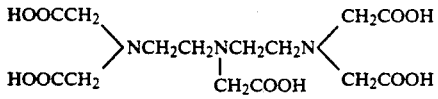

(K-2)

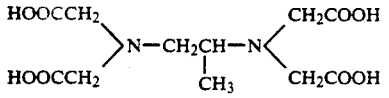

(K-3)

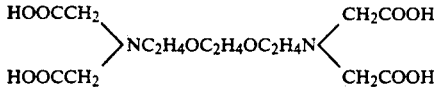

(K-4)

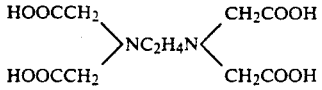

(K-5)

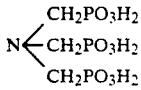

(K-6)

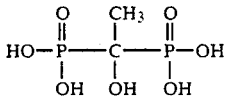

(K-7)

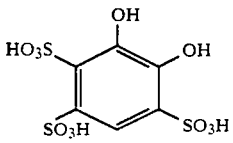

(K-8)

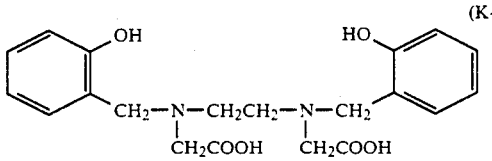

(K-9)

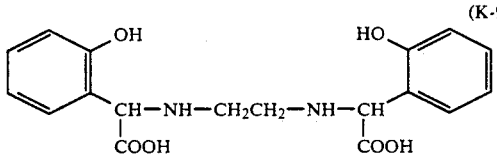

(K-10)

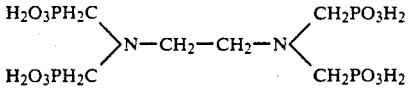

In addition to the above exemplified compounds there may also be used sodium salts, potassium salts, lithium salts and quaternary ammonium salts of the above compounds, and further the chelating compounds (1) to (105) that are exemplified in JP O.P.I. No. 48548/1988.

In the invention, it is more effective to use at least one of the chelating agents represented by Formulas K-IV, K-V, K-VIII, K-IX or K-XV, and more preferably those represented by Formulas K-VII, K-VIII or K-XV.

Examples of the particularly useful chelating agents for the invention are given below. These agents may be used alone or in combination.

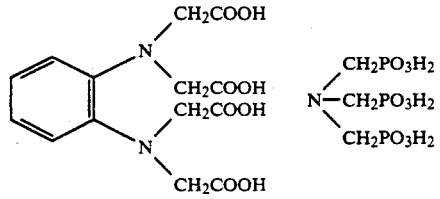

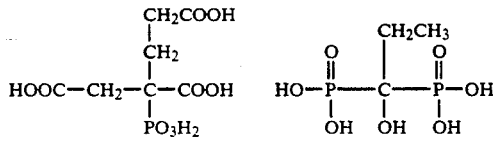

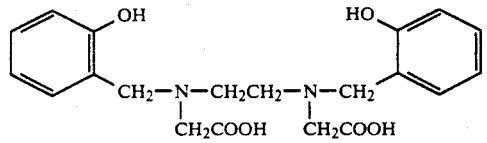

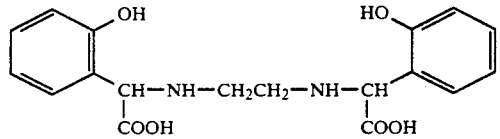

Any of the above chelating agents having Formulas K-I to K-III for the invention may be used in an amount of $1\times10^{-4}$ mol to 1 mol, more preferably $2\times10^{-4}$ mol to $1\times10^{-1}$ mol and most preferably $5\times10^{-4}$ mol to $5\times10^{-2}$ mol per liter of the concentrated color developer composition of the invention.

The effect of the invention is enhanced by adjusting pH of the concentrated color developer composition to not less than 10.6.

In the concentrated color developer composition, the use of less-dissolvent organic solvents such as benzyl alcohol and phenethyl alcohol should preferably be avoided in consideration of the effect of the invention.

The concentrated color developer composition of the invention may, if necessary, contain an organic solvent such as ethylene glycol, methyl cellosolve, methanol, acetone, dimethylformamide, $\beta$-cyclodextrine, diethylene glycol or triethanolamine, or one of those compounds described in JP E.P. Nos. 33378/1972 and 9509/1969 to exhibit satisfactorily the effect of the invention.

It is preferable to incorporate a triazinylstilbene brightening agent into the concentrated color developer composition of the invention.

As the triazinylstilbene brightening agent there may be used those described in Japanese Patent Application No. 59466/1991, paragraph Nos. 0038 to 0042.

Particularly, the use of the following exemplified compounds E-4, E-24, E-34, E-35, E-36, E-37 and E-44 is preferable for the effect of the invention.

(E-4)
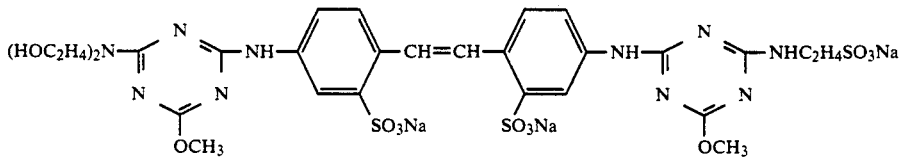
(E-24)
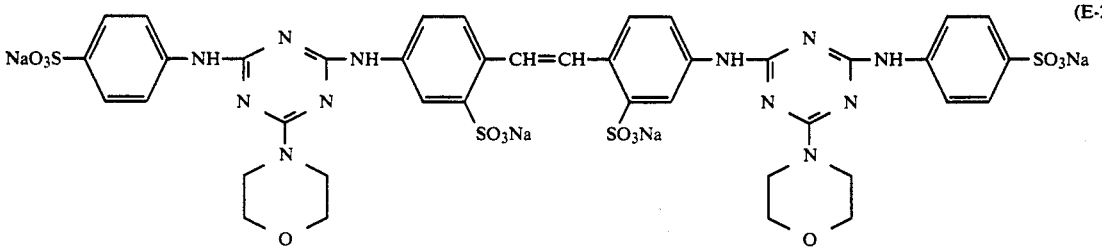
(E-34)
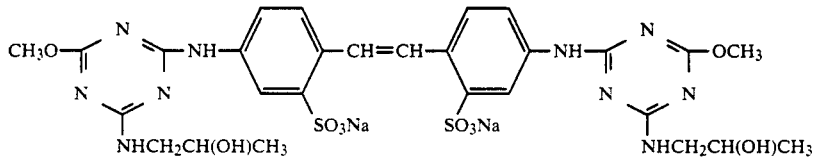
(E-35)
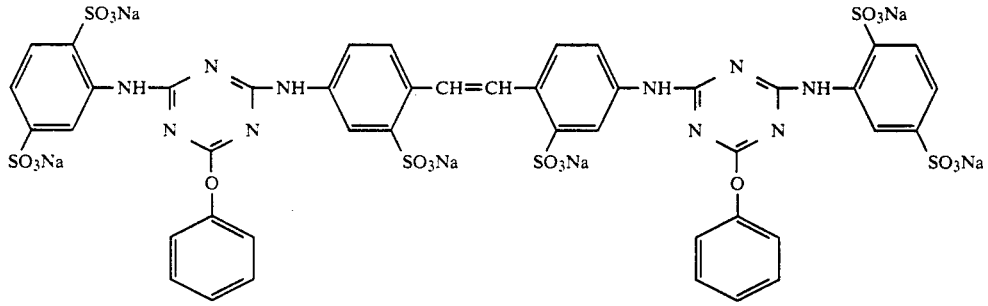
(E-36)
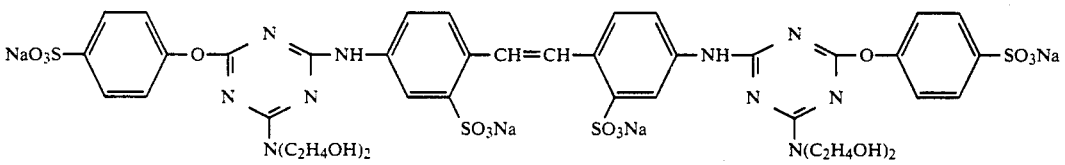
(E-37)
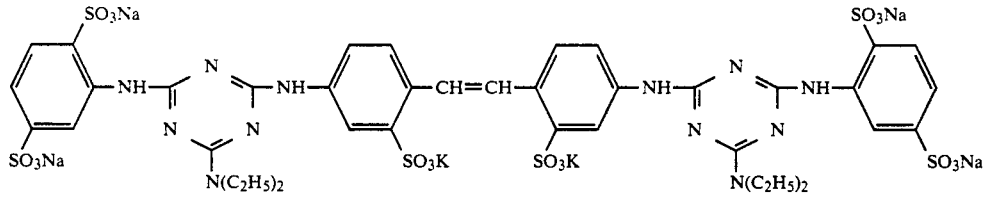
(E-41)
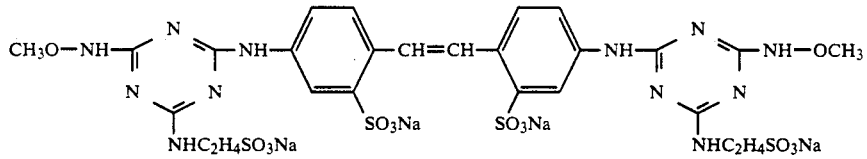
(E-44)
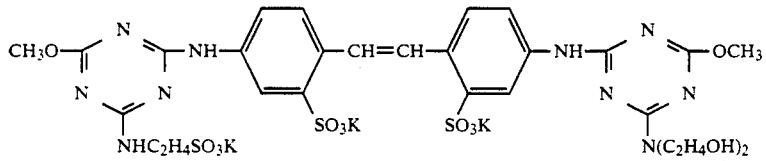

Further, the incorporation of one of water-soluble surface active agents of the following Formulas S-I to S-XI into the concentrated color developer composition of the invention is preferable for the effect of the invention.

$$R^1X(E^1)_{k1}-(E^2)_{m1}-(E^3)_{n1}-R^2 \qquad \text{Formula S-I}$$

wherein $R^1$ represents a hydrogen atom, an aliphatic group or an acyl group; $R^2$ represents a hydrogen atom or an aliphatic group; $E^1$ is ethylene oxide; $E^2$ is propylene oxide; $E^3$ is ethylene oxide; X is an oxygen atom or a $-NR^3-$ group; $R^3$ is an aliphatic group, a hydrogen atom or $-(E^1)_{k2}-(E^2)_{m2}-(E^3)_{n2}-R^4$, wherein $R^4$ is a hydrogen atom or an aliphatic group; and $k_1$, $k_2$, $m_1$, $m_2$, $n_1$ and $n_2$ each represent a value of 0 to 300, provided that when $R^1$ and $R^2$ are hydrogen atoms, two out of $k_1$, $m_1$ and $n_1$ are zero and the remaining one does not come to 1.

$$A_2-O-(B)_m-(C)_n-X_1 \qquad \text{Formula S-II}$$

wherein $A_2$ is a monovalent organic group, e.g., an alkyl group having 6 to 50, preferably 6-35 carbon atoms, such as hexyl, heptyl, octyl, nonyl, decyl, undecyl or dodecyl, or an aryl group substituted by an alkyl group having 3 to 35 carbon atoms or an alkenyl group having 2 to 35 carbon atoms, but does not represent a hydrogen atom.

Useful examples of the substituent to the above aryl group include alkyl groups having 1 to 18 carbon atoms, such as methyl, propyl, butyl, pentyl, hexyl, heptyl, octyl, nonyl, decyl, undecyl and dodecyl; substituted alkyl groups such as benzyl or phenethyl; alkenyl groups having 2 to 20 carbon atoms, e.g., unsubstituted alkenyl groups such as olecyl, cetyl and allyl, and substituted alkenyl groups such as styryl. The aryl group is a phenyl, biphenyl or naphthyl group, and preferably a phenyl group. The substituting position to the aryl group may be any of the ortho, meta and para positions, and the aryl group may be substituted by a plurality of such substituents.

B or C represents ethylene oxide, propylene oxide or $$\left(CH_2\right)_{n1}\left(\underset{\substack{|\\OH}}{CH}\right)_{m1}\left(CH_2\right)_{k1}-O-,$$

provided that $n_1$, $m_1$ and $k_1$ each represent an integer of 0, 1 or 3, but the three can not be zero at the same time.

m and n each represent an integer of 0 to 100.

$X_1$ is a hydrogen atom, an alkyl group or an aralkyl group, examples of which include the same groups as defined in $A_2$.

$$R^1-(X-L)_k-COOM \qquad \text{Formula S-III}$$

wherein $R^1$ represents an aliphatic group such as a saturated or unsaturated, substituted or unsubstituted and straight-chain or branched-chain alkyl group; and X represents $$-\underset{\substack{|\\R^2}}{CON}- \quad \text{or} \quad -\underset{\substack{|\\R^3}}{SO_2N}-$$

wherein $R^2$ and $R^3$ each represent a hydrogen atom or a group as defined for $R^1$; k is an integer of 0 or 1; M is a hydrogen atom or an alkali metal atom such as Na or K, an ammonium ion or an organic ammonium ion; and L represents an alkylene group.

$$R^1-(X-L)_k-(Y)_q-SO_3M \qquad \text{Formula IV}$$

wherein $R^1$ represents an aliphatic group such as a saturated or unsaturated, substituted or unsubstituted and straight-chain or branched-chain alkyl group; X represents $$-\underset{\substack{|\\R^2}}{CON}-, \quad -\underset{\substack{|\\R^3}}{SO_2N}-$$

or —COO—, wherein $R^2$ and $R^3$ each represent a hydrogen atom or a group as defined for $R^1$; k and q each are an integer of 0 or 1; L is an alkylene group; Y is an oxygen atom; and M is an alkali metal atom such as Na, K or Li.

$$A_2-O-(CH_2CH_2O)_n-SO_3M \qquad \text{Formula S-V}$$

wherein M represents an alkali metal atom such as Na, K or Li; n is an integer of 1 to 100; $A_2$ is a monovalent organic group, e.g., an alkyl group having 6 to 20, more preferably 6 to 12 carbon atoms, such as hexyl, heptyl, octyl, nonyl, decyl, undecyl or dodecyl, or an aryl group substituted by an alkyl group having 3 to 20 carbon atoms, wherein the substituent is preferably an alkyl group having 3 to 12 carbon atoms, such as propyl, butyl, pentyl, hexyl, heptyl, octyl, nonyl decyl, undecyl or dodecy; and the aryl group is a phenyl, tolyl, xynyl, biphenyl or naphthyl group, and preferably a phenyl or tolyl group. The alkyl group-substituting position to the aryl group may be any of the ortho, meta and para positions.

Formula S-VI $$R_5-\overset{\substack{R_4\\|}}{\underset{\substack{|\\R^6}}{N}}{}^{\oplus}-A-COO^{\ominus}$$

wherein $R_4$, $R_5$ and $R_6$ each represent a substituted or unsubstituted alkyl group, provided that each pair of $R_4$ and $R_5$ or $R_5$ and $R_6$ may form a ring; and A represents $-(CH)_n-$, wherein n is an integer of 1, 2 or 3.

Formula S-VII $$R_1-\underset{\substack{|\\(R_2)_m}}{N}\left(A-X\right)_n$$

wherein $R_1$ is as defined for $A_2$ of Formula S-II; $R_2$ is a hydrogen atom or an alkyl group such as methyl or ethyl; m and n each represent an integer of 0, 1 or 2; A is an alkyl group or a substituted or unsubstituted aryl group; X is —COOM or $-SO_3H$; and M is a hydrogen atom or an alkali metal atom.

Formula S-VIII $$R_5-\overset{\substack{R_4\\|}}{\underset{\substack{|\\R_6}}{N}}{}^{\oplus}-R_7.X^{\ominus}$$

wherein $R_4$, $R_5$ and $R_6$ each represent a hydrogen atom, a substituted or unsubstituted alkyl group or a phenyl group; X is an anion such as of a halogen ion, a hydroxyl ion, a sulfate ion, a carboxylate ion, a nitrate ion, an acetate ion or p-toluenesulfonate ion.

Formula S-IX

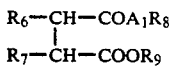

wherein either one of $R_6$ and $R_7$ represents a hydrogen atom or an alkyl group, while the other is a group represented by $—SO_3M$, wherein M is a hydrogen atom or a monovalent cation; $A_1$ is a hydrogen atom or a group represented by $—NR_{10}—$, wherein $R_{10}$ is a hydrogen atom or an alkyl group having 1 to 8 carbon atoms; and $R_8$ and $R_9$ each represent an alkyl group having 4 to 30 carbon atoms, provided that an alkyl group represented by $R_8$, $R_9$ or $R_{10}$ may be substituted by a fluorine atom.

Formula S-X

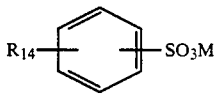

Formula S-XI

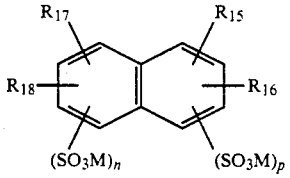

wherein $R_{14}$, $R_{15}$, $R_{16}$, $R_{17}$ and $R_{18}$ each represent a hydrogen atom or an alkyl group; M is as defined in Formul S-III; and n and p each represent an integer of 0 or 1 to 4 and a value satisfying $1 \leqq n+p \leqq 8$.

The following are the examples of the compounds represented by Formulas S-I through S-X and S-XI, but the invention is not limited by the examples.

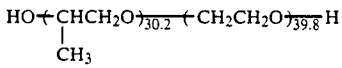

(S-1)

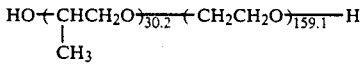

(S-2)

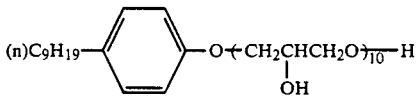

(S-3)

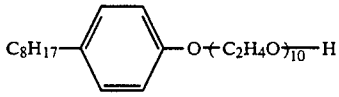

(S-4)

and the water-soluble surface active agent exemplified compounds (I-1) to (I-12), (I-15) to (I-25), (II-1) to (II-4), (II-6) to (II-36), (II-38) to (II-78), (III-1) to (III-6), (IV-1) to (IV-11), (V-1) to (V-7), (VI-1) to (VI-6), (VII-1) to (VII-3), (VIII-1) to (VIII-27), (IX-1) to (IX-17), (X-1), (X-2) and (XI-1) to (XI-11) that are described in Japanese Patent O.P.I. Publication No. 223757/1991.

The water-soluble surface active agent for the concentrated color developer composition of the invention is used in the amount range of preferably 0.5 to 20 g/liter, and more preferably 1.0 to 15 g/liter.

The water-soluble surface active agent content of the concentrated color developer composition need only be 0.5 to 20 g/liter, including the carried-in amount of the surface active agent eluted from the silver halide color photographic material in processing, but it is preferable to add in advance the above amount of the agent to the color developer solution in consideration of the effect of the invention. That is, the amount of the water-soluble surface active agent eluted from the light-sensitive material is only slight but becomes accumulated while processing is repeated in succession, the effect of which is quite different from the case where the agent is added in advance to the color developer solution.

The water-soluble surface active agent of the invention is to be used at least alone but may be used in combination of two or more kinds thereof.

Preferably usable water-soluble surface active agents for the invention are nonionic surface active agents, more preferably compounds represented by Formulas S-I and S-II, and most preferably those represented by Formula S-I.

The compound of Formula S-I little affects the developing characteristic even when used in a color developer solution prepared from the concentrated color developer composition that has been stored over a long period and besides it causes no foam, so that it can be used in a large amount, and makes the effect of the invention more significant, and therefore the use of the compound is a preferred embodiment of the invention.

Cationic surface active agents, when added to the color developer solution, may produce a precipitation during a continuous processing, and anionic surface active agents have relatively low solubility, while the above nonionic surface active agents scarcely cause these problems.

The concentrated color developer composition may, if necessary, contain a halogen ion such as $Cl^-$, $Br^-$ or $I^-$ in the form of a salt.

To the color developer solution and color developer replenisher used in the invention may be added additionally the constituents of the foregoing concentrated color developer composition, and further an alkali agent, a color developing agent and, if necessary, an inorganic or organic antifoggant, and still further a development accelerator as needed.

Useful examples of the above alkali agent include sodium carbonate, potassium carbonate, sodium hydroxide, potassium hydroxide, sodium silicate, potassium silicate, sodium metaborate, potassium metaborate, trisodium phosphate, tripotassium phosphate and borax. These may be used alone or in combination. Further, various salts such as disodium hydrogenphosphate, dipotassium hydrogenphosphate, sodium hydrogencarbonate, potassium hydrogencarbonate and potassium borate may be used from necessity for preparation or for the purpose of increasing the ion strength.

As the color developing agent there may be used any one of the water-soluble group-having p-phenylenediamine compounds described in JP O.P.I. No. 48548/1988.

After being color-developed in the color developer solution of the invention, a light-sensitive material is then processed in a processing solution having a fixing ability, but where the fixing ability-having solution is a fixing bath, the light-sensitive material is subjected to bleaching treatment prior to the fixing. As the bleaching, fixing and bleach-fix solutions there may be used those described in, e.g., JP O.P.I. No. 48548/1988.

After the fixing and bleach-fixing, the light-sensitive material may be either washed or stabilized without washing.

Aside from the above process, known auxiliary processes such as neutralization, black-and-white development, reversal processing, washing with a small amount of water, etc., may. if necessary, be additionally employed.

The concentrated color developer composition of the invention may apply to any silver halide photographic light-sensitive materials with no restriction.

EXAMPLES

The invention is illustrated further in detail by the following examples.

EXAMPLE 1

Experiment Step 1

A concentrated color developer composition A of the following composition was prepared:

| Concentrated color developer composition A | |
|---|---|
| Compound of Formula A. B or C | Described in Table 1 |
| Compound of Formula K-I. K-II or K-III | Described in Table 1 |
| Water-soluble surface active agent | Described in Table 1 |
| Ethylene glycol | 8 g |
| Brightening agent | Described in Table 1 |
| Pure Water | 20 ml |

This concentrated color developer composition A was put in a 30 ml polyethylene container hermetically sealed; allowed to stand at 50° C. for a period of 60 days; and then examined in accordance with a gas chromatography method with respect to the residual amount of the compound of Formula A, B or C. The results are shown in Table 1.

Experiment Step 2

The following silver halide color photographic light-sensitive material was prepared.

A paper support with one surface laminated with polyethylene and the other laminated with polyethylene containing titanium oxide was used and the following layers were coated on the titanium oxide-containing polyethylene laminated side, whereby a multilayer color light-sensitive material (b) was prepared. Coating liquids for the respective layers were prepared as follows:

Coating liquid for Layer 1

Twenty-six point seven grams of yellow coupler Y-1, 100 g of dye image stabilizer ST-1, 6.67 g of ST-2, and 0.67 g of additive HQ-1 were dissolved in 6.67 g of high-boiling solvent DNP with 60 ml of ethyl acetate, and this solution was emulsifiedly dispersed in 220 ml of a 10% gelatin aqueous solution containing 7 ml of a 20% surface active agent SU-1 by using a supersonic homogenizer to thereby prepare a yellow coupler dispersion. This dispersion was mixed with a blue-sensitive silver halide emulsion (containing 10 g of silver) prepared according to the following conditions, whereby a coating liquid for Layer 1 was prepared.

Coating liquids for Layers 2 to 7 also were prepared in like manner.

As hardening agents, H-1 was added to Layer 2 and Layer 4, and H-2 was added to Layer 7. As coating aids, surface active agent SU-2 and Su-3 were added to adjust the surface tension of these coating liquids.

| Layer | Composition | Added amount ($g/m^2$) |
|---|---|---|
| Layer 7 (Protective Layer) | Gelatin | 1.0 |
| Layer 6 (UV absorbing layer) | Gelatin | 0.4 |
| | UV absorbent UV-1 | 0.10 |
| | UV absorbent UV-2 | 0.04 |
| | UV absorbent UV-3 | 0.17 |
| | Antistain agent HQ-1 | 0.01 |
| | DNP | 0.2 |
| | PVP | 0.03 |
| | Antiirradiation dye AI-2 | 0.02 |
| Layer 5 (Red-sensitive layer) | Gelatin | 1.30 |
| | Red-sensitive silver chlorobromide emulsion EmC, silver equivalent | 0.21 |
| | Cyan coupler C-1 | 0.17 |
| | Cyan coupler C-2 | 0.25 |
| | Dye image stabilizer ST-1 | 0.20 |
| | Antistain agent HQ-1 | 0.01 |
| | HBS-1 | 0.20 |
| | DOP | 0.20 |
| Layer 4 (UV absorbing layer) | Gelatin | 0.97 |
| | UV absorbent UV-1 | 0.28 |
| | UV absorbent UV-2 | 0.09 |
| | UV absorbent UV-3 | 0.38 |
| | Antistain agent HQ-1 | 0.03 |
| | DNP | 0.40 |
| Layer 3 (Green-sensitive layer) | Gelatin | 1.40 |
| | Green-sensitive silver chlorobromide emulsion EmB, silver equivalent | 0.17 |
| | Magenta coupler M-1 | 0.33 |
| | Dye image stabilizer ST-3 | 0.15 |
| | Dye image stabilizer ST-4 | 0.15 |
| | Dye image stabilizer ST-5 | 0.15 |
| | DNP | 0.19 |
| | Antiirradiation dye AI-1 | 0.01 |
| Layer 2 (Intermediate layer) | Gelatin | 1.10 |
| | Antistain agent HQ-2 | 0.12 |
| | DIDP | 0.15 |
| Layer 1 (Blue-sensitive layer) | Gelatin | 1.20 |
| | Blue-sensitive silver chlorobromide emulsion EmA, silver equivalent | 0.26 |
| | Yellow coupler Y-1 | 0.77 |
| | Dye image stabilizer ST-1 | 0.30 |
| | Dye image stabilizer ST-2 | 0.20 |
| | Antistain agent HQ-1 | 0.02 |
| | Antiirradiation dye AI-3 | 0.01 |
| | DNP | 0.20 |
| Support | Polyethylene-laminated paper | |

Y-1
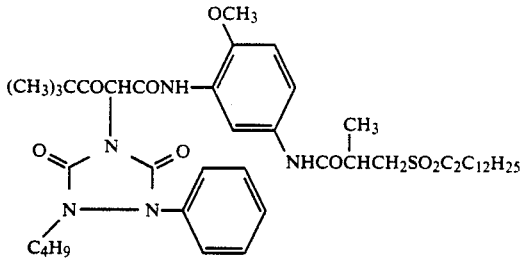
M-1
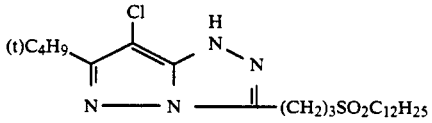
C-1
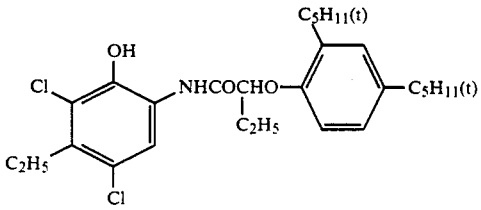
C-2
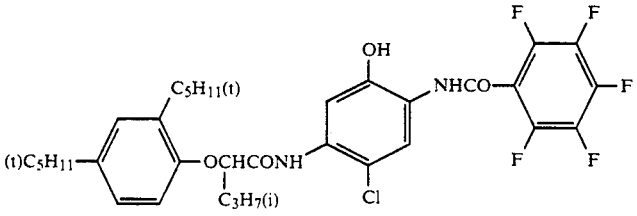
ST-1
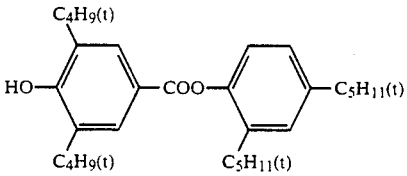
ST-2
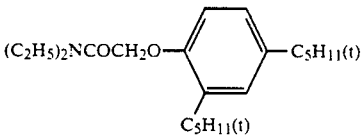
ST-3
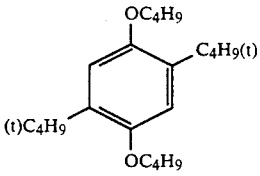
ST-4
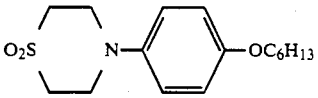
ST-5
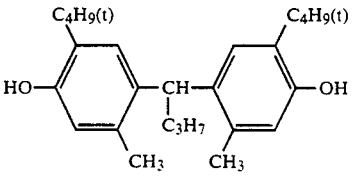

-continued
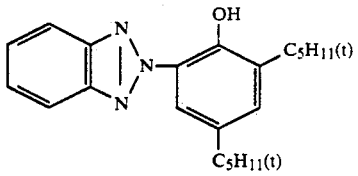
UV-1
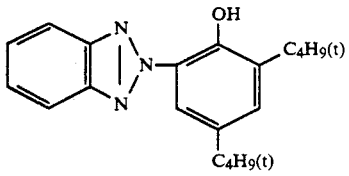
UV-2
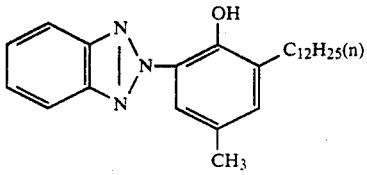
UV-3
| | | | |
|---|---|---|---|
| DOP | Dioctyl phthalate | DNP | Dinonyl phthalate |
| DIDP | Diisodecyl phthalate | PVP | Polyvinyl pyrrolidone |
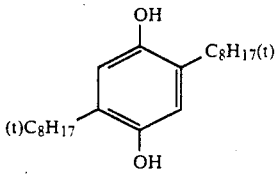
HQ-1
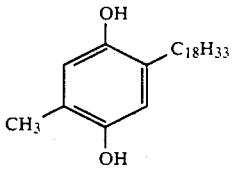
HQ-2
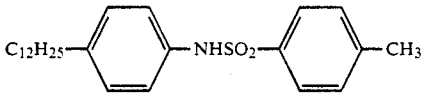
HBS-1
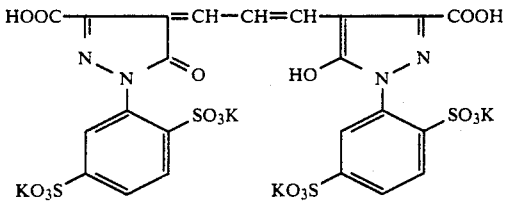
AI-1
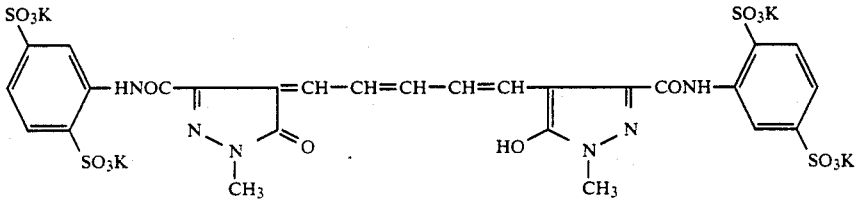
AI-2

-continued

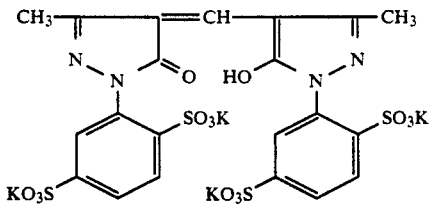

AI-3

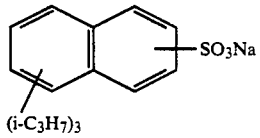

SU-1

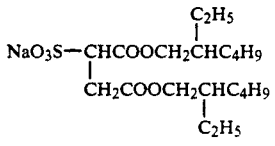

SU-2

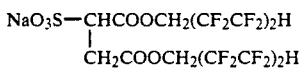

SU-3

H-1

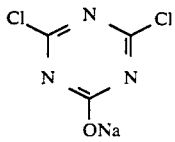

H-2

Preparation of Blue-Sensitive Silver Halide Emulsion

To 1,000 ml of a 2% gelatin aqueous solution kept at 40° C. the following Solution A and Solution B, while controlling their pAg and pH to 6.5 and 3.0, respectively, were simultaneously added spending 30 minutes, and further the following Solution C and Solution D, while controlling their pAg and pH to 7.3 and 5.5, respectively, were simultaneously added spending 180 minutes.

In the above, the control of pAg was made in accordance with the relevant method described in JP O.P.I. No. 45437/1984, while the control of pH was made by using an aqueous solution of sulfuric acid or sodium hydroxide.

| | |
|---|---|
| Solution A | |
| Sodium chloride | 3.45 g |
| Potassium bromide | 0.03 g |
| Water to make 200 ml | |
| Solution B | |
| Silver nitrate | 11 g |
| Water to make 200 ml | |
| Solution C | |
| Sodium chloride | 103.4 g |
| Potassium bromide | 1.0 g |
| Water to make 600 ml | |
| Solution D | |
| Silver nitrate | 300 g |
| Water to make 600 ml | |

After completion of the addition, the emulsion was desalted by using a 5% aqueous solution of Demol N, produced by Kawo Atlas Co., and a 20% aqueous solution of magnesium sulfate, and then mixed with an aqueous gelatin solution, whereby a monodisperse cubic emulsion EMP-1, having an average grain diameter of 0.85 μm, a grain size variation coefficient ($\sigma/\bar{r}$) of 0.07 and a silver chloride content of 99.5 mol %, was obtained. In the above, $\sigma$ is a standard deviation of grain size distribution, while $\bar{r}$ is an average size of the grains.

The above emulsion EMP-1, with use of the following compounds, was chemically ripened at 50° C. for 90 minutes, whereby a blue-sensitive silver halide emulsion Em-B was obtained.

| | |
|---|---|
| Sodium thiosulfate | 0.8 mg/mol of AgX |
| Chloroauric acid | 0.5 mg/mol of AgX |
| Stabilizer STAB-1 | $6 \times 10^{-4}$ mol/mol of AgX |
| Sensitizing dye BS-1 | $4.3 \times 10^{-4}$ mol/mol of AgX |
| Sensitizing dye BS-2 | $0.7 \times 10^{-4}$ mol/mol of AgX |

Preparation of Green-Sensitive Silver Halide Emulsion

A monodisperse cubic emulsion EMP-2, having an average grain diameter of 0.43 μm and a coefficient of variation ($\sigma/r$) of 0.08 and a silver chloride content of 99.5 mol %, was prepared in the same manner as in EMP-1 except that the adding period of time of Solutions A and B and that of Solutions C and D were changed.

Emulsion EMP-2, with use of the following compounds, was chemically ripened at 55° C. for 120 minutes, whereby a green-sensitive silver halide emulsion Em-G was obtained.

| | |
|---|---|
| Sodium thiosulfate | 1.5 mg/mol of AgX |
| Chloroauric acid | 1.0 mg/mol of AgX |
| Stabilizer STAB-1 | $6 \times 10^{-4}$ mol/mol of AgX |

-continued

| | |
|---|---|
| Sensitizing dye GS-1 | $4 \times 10^{-4}$ mol/mol of AgX |

Preparation of Red-Sensitive Silver Halide Emulsion

A monodisperse cubic emulsion EMP-3, having an average grain diameter of 0.50 μm, a coefficient of variation ($\sigma/r$) or 0.08 and a silver chloride content of 99.5 mol %, was prepared in the same manner as in EMP-1 except that the adding period of time of Solutions A and B and that of Solutions C and D were changed.

Emulsion EMP-3, with use of the following compounds, was chemically ripened at 60° C. for 90 minutes, whereby a red-sensitive silver halide emulsion Em-R was obtained.

| | |
|---|---|
| Sodium thiosulfate | 1.6 mg/mol of AgX |
| Chloroauric acid | 2.2 mg/mol of AgX |
| Stabilizer STAB-1 | $6 \times 10^{-4}$ mol/mol of AgX |
| Sensitizing dye RS-1 | $1 \times 10^{-4}$ mol/mol of AgX |

BS-1

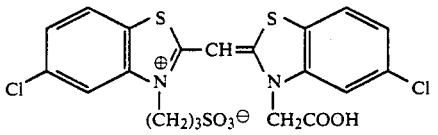

BS-2

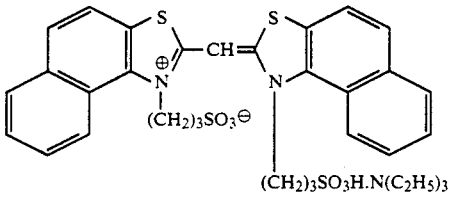

GS-1

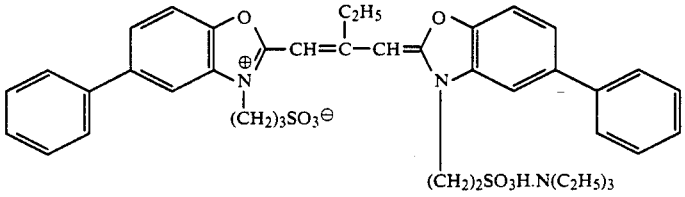

RS-1

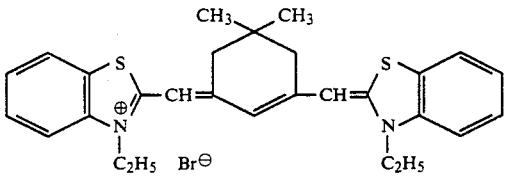

STAB-1

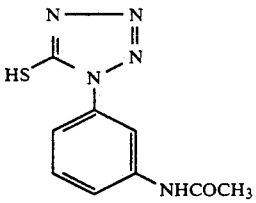

The prepared light-sensitive material sample was exposed in the usual manner, and then processed in the following processing steps.

| Processing step | Temperature | Time |
|---|---|---|
| (1) Color developing | 35.0 ± 0.3° C. | 45 seconds |
| (2) Bleach-fixing | 35.0 ± 0.5° C. | 45 seconds |
| (3) Stabilizing (Tribath cascade) | 30 to 34° C. | 90 seconds |
| (4) Drying | 60 to 80° C. | 30 seconds |

Color Developer Solution

To 800 ml of water was added the foregoing color developer composition A that had been allowed to stand for 60 days, and then were added the following color developer compositions B, C and D with stirring, and pH of the solution was adjusted to 10.05 by using KOH or $H_2SO_4$.

| Color developer composition B | |
|---|---|
| Water | 30 ml |
| Potassium sulfite | $5 \times 10^{-4}$ mol |
| Color developing agent, 3-methyl-4-amino-N-ethyl-(β-methanesulfonamidoethyl)-aniline sulfate | 5.5 g |

-continued

| | |
|---|---|
| Color developer composition C | |
| Water | 50 ml |
| Potassium carbonate | 28 g |
| Diethylenetriamine pentaacetate | 1.0 g |
| Color developer composition D (starter) | |
| Potassium chloride | 2.6 g |
| Water | 40 ml |

Bleach-Fix Bath

| | |
|---|---|
| Ferric ammonium ethylenediaminetetraacetate | 55.0 g |
| Ethylenediaminetetraacetic acid | 3.0 g |
| Ammonium thiosulfate (70% solution) | 123.0 g |
| Ammonium sulfite (40% solution) | 51.0 g |
| Adjust pH to 5.4 with ammonia water or glacial acetic acid. | |
| Water to make 1 liter. | |

Stabilizing Bath

| | |
|---|---|
| o-Phenyl-phenol | 0.15 g |
| Uvitex, produced by Ciba Geigy | 1.0 g |
| $ZnSO_4.7H_2O$ | 0.15 g |
| Ammonium sulfite (40% solution) | 5.0 ml |
| 1-Hydroxyethylidene-1,1-diphosphonic acid (60% solution) | 2.6 g |
| Ethylenediaminetetraacetic acid | 1.5 g |
| Adjust pH to 7.8 with ammonia water or sulfuric acid. | |
| Water to make 1 liter. | |

Evaluation

Dmax G, a green-light-reflection density of the maximum density area, of the above processed color paper was measured with a PDA65 densitometer, manufactured by KONICA Corp. The results are shown in Table 1.

TABLE 1

| Experiment No. | Compound of Formula A, B or C | | Compound of Formula K-1 to K-III | | Water-soluble surfactant | | Brightening agent | | Residual rate (%) of Cpd. Formula A to C | Dmax G |
|---|---|---|---|---|---|---|---|---|---|---|
| | Cpd. name | Added amt. | Cpd. name | Added amt. | Cpd. name | Added amt. | Cpd. name | Added amt. | | |
| 1-1 (unaged) | B-23 | 5 g | None | 5 g | S-2 | 0 g | E-37 | 2 g | 100 | 2.41 |
| 1-2 (Comp.) | B-23 | 5 | None* | 0 | None | 0 | E-37 | 2 | 16 | 2.70 |
| 1-3 (Comp.) | B-23 | 5 | None* | 0 | S-2 | 3 | E-37 | 2 | 23 | 2.68 |
| 1-4 (Inv.) | B-23 | 5 | K-1 | 5 | S-2 | 3 | E-37 | 2 | 95 | 2.45 |
| 1-5 (Inv.) | B-23 | 5 | K-4 | 5 | S-2 | 3 | E-37 | 2 | 97 | 2.43 |
| 1-6 (Inv.) | B-23 | 5 | K-7 | 5 | S-2 | 3 | E-37 | 2 | 98 | 2.42 |
| 1-7 (Inv.) | B-23 | 5 | K-10 | 5 | S-2 | 3 | E-37 | 2 | 99 | 2.41 |
| 1-8 (Inv.) | B-3 | 5 | K-1 | 5 | S-2 | 3 | E-37 | 2 | 97 | 2.43 |
| 1-9 (Comp.) | C-18 | 5 | None* | 0 | S-2 | 3 | E-37 | 2 | 65 | 2.67 |
| 1-10 (Inv.) | C-18 | 5 | K-1 | 5 | S-2 | 3 | E-37 | 2 | 96 | 2.45 |
| 1-11 (Inv.) | C-19 | 5 | K-1 | 5 | S-2 | 3 | E-37 | 2 | 95 | 2.43 |
| 1-12 (Inv.) | C-24 | 5 | K-1 | 5 | S-2 | 3 | E-37 | 2 | 98 | 2.41 |
| 1-13 (Inv.) | C-18 | 5 | K-4 | 5 | S-2 | 3 | E-37 | 2 | 94 | 2.40 |
| 1-14 (Inv.) | C-18 | 5 | K-7 | 5 | S-2 | 3 | E-37 | 2 | 95 | 2.43 |
| 1-15 (Inv.) | C-18 | 5 | K-10 | 5 | S-2 | 3 | E-37 | 2 | 97 | 2.44 |
| 1-16 (Inv.) | B-23 | 5 | K-1 (Na salt) | 5 | S-2 | 3 | E-37 | 2 | 98 | 2.42 |
| 1-17 (Inv.) | B-23 | 5 | K-1 | 5 | S-2 | 3 | E-37 | 2 | 96 | 2.41 |
| 1-18 (Inv.) | B-23 | 5 | K-1 | 5 | S-2 | 3 | E-37 | 2 | 97 | 2.41 |
| 1-19 (Inv.) | B-23 | 5 | K-1 | 5 | S-4 | 0.1 | E-37 | 2 | 97 | 2.46 |
| 1-20 (Inv.) | B-15 | 5 | K-1 | 5 | S-2 | 3 | E-37 | 2 | 98 | 2.41 |

Note:
*5 grams of K-1 were added to other color developer composition for preparation of a color developer solution.

As is apparent from Table 1, the concentrated color developer composition of the invention is scarcely decomposed even after being allowed to stand over a long period and shows almost the same developability as was in the fresh state.

EXAMPLE 2

Experiments were made in the same manner as in Example 1 except that the brightening agents used in Experiments Nos. 1 to 4 were replaced by those shown in Table 2. The results are given in Table 2.

TABLE 2

| Experiment No. | Brightening agent | Added amount | Residual rate (%) of Compound of Formula A to C |
|---|---|---|---|
| 2-1 (Inv.) | E-41 | 2 g/l | 92 |
| 2-2 (Inv.) | E-4 | 2 g/l | 97 |
| 2-3 (Inv.) | E-34 | 2 g/l | 95 |
| 2-4 (Inv.) | E-35 | 2 g/l | 97 |
| 2-5 (Inv.) | E-36 | 2 g/l | 96 |
| 2-6 (Inv.) | E-44 | 2 g/l | 98 |

It is apparent that the use of brightening agent E-4, E-34, E-35, E-36, E-37 or E-44 makes the effect of the invention especially significant.

EXAMPLE 3

Experiments were made in the same manner as in Example 1 except that the water-soluble surface active agent used in Experiment No.1-4 was replaced by S-1 and S-4. As a result, similar results to Example 1 were obtained.

EXAMPLE 4

Experiments were made in the same manner as in Example 1 except that the ethylene glycol contained in the concentrated color developer composition A in Experiment Nos. 1-2 to 1-6, 1-13, 1-14 and 1-15 was replaced by diethylene glycol and triethanolamine. Then, almost the same results within an experimental error as in Example 1 were obtained.

EXAMPLE 5

A color light-sensitive material sample was prepared in the following example, in which the adding amounts of the following constituents are shown in grams per $m^2$ except that silver halide and colloidal silver are shown in silver equivalent.

Color Light-Sensitive Material

A subbing treatment was made on one side (obverse side) of a triactyl cellulose film support and then the following compositions-having layers were formed in sequence on the other side (reverse side) opposit to the subbed side.

| | |
|---|---|
| Reverse side layer 1 | |
| Aluminasol AS-100 (aluminum oxide), produced by Nissan Chemical Ind. Co. | 0.8 g |
| Reverse side layer 2 | |
| Diacetyl cellulose | 100 mg |
| Stearic acid | 10 mg |
| Silica fine particles (average particle size: 0.2 μm) | 50 mg |

Subsequently, on the subbed obverse side of the triacetyl cellulose film support were coated the following layers in order from the support side, whereby a multilayer color photographic light-sensitive material sample a-1 was prepared.

| | |
|---|---|
| Layer 1: Antihalation layer (HC) | |
| Black colloidal silver | 0.14 g |
| UV absorbent UV-1 | 0.20 g |
| Colored cyan coupler CC-1 | 0.02 g |
| High-boiling solvent Oil-1 | 0.20 g |
| High-boiling solvent Oil-2 | 0.20 g |
| Gelatin | 1.6 g |
| Layer 2: Intermediate layer (IL-1) | |
| Gelatin | 1.3 g |
| Layer 3: Low-speed red-sensitive emulsion layer R-L | |
| Silver iodobromide emulsion (average grain size: 0.3 μm) | 0.4 g |
| Silver iodobromide emulsion (average grain size: 0.4 μm) | 0.3 g |
| Sensitizing dye S-1 | $3.0 \times 10^{-4}$ mol/mol Ag |
| Sensitizing dye S-2 | $3.2 \times 10^{-4}$ mol/mol Ag |
| Sensitizing dye S-3 | $0.2 \times 10^{-4}$ mol/mol Ag |
| Cyan coupler C-1 | 0.50 g |
| Cyan coupler C-2 | 0.12 g |
| Colored cyan coupler CC-1 | 0.07 g |
| DIR compound D-1 | 0.006 g |
| DIR compound D-2 | 0.01 g |
| High-boiling solvent Oil-1 | 0.55 g |
| Gelatin | |
| Layer 4: High-speed red-sensitive emulsion layer R-H | |
| Silver iodobromide emulsion (average grain size: 0.7 μm) | 0.9 g |
| Sensitizing dye S-1 | $1.7 \times 10^{-4}$ mol/mol Ag |
| Sensitizing dye S-2 | $1.6 \times 10^{-4}$ mol/mol Ag |
| Sensitizing dye S-3 | $0.1 \times 10^{-4}$ mol/mol Ag |
| Cyan couplder C-2 | 0.23 g |
| Colored cyan coupler CC-1 | 0.03 g |
| DIR compound D-2 | 0.02 g |
| High-boiling solvent Oil-1 | 0.25 g |
| Gelatin | 1.0 g |
| Layer 5: Intermediate layer IL-2 | |
| Gelatin | 0.8 g |
| Layer 6: Low-speed green-sensitive emulsion layer G-L | |
| Silver iodobromide emulsion (average grain size: 0.4 μm) | 0.6 g |
| Silver iodobromide emulsion (average grain size: 0.3 μm) | 0.2 g |
| Sensitizing dye S-4 | $6.7 \times 10^{-4}$ mol/mol Ag |
| Sensitizing dye S-5 | $1.0 \times 10^{-4}$ mol/mol Ag |
| Magenta coupler M-A | 0.17 g |

-continued

| | |
|---|---|
| Magenta coupler M-B | 0.43 g |
| Colored magenta coupler CM-1 | 0.10 g |
| DIR compound D-3 | 0.021 g |
| High-boiling solvent Oil-2 | 0.7 g |
| Gelatin | 1.0 g |
| Layer 7: High-speed green-sensitive emulsion layer G-H | |
| Silver iodobromide emulsion (average grain size: 0.7 μm) | 0.9 g |
| Sensitizing dye S-6 | $1.1 \times 10^{-4}$ mol/mol Ag |
| Sensitizing dye S-7 | $2.0 \times 10^{-4}$ mol/mol Ag |
| Sensitizing dye S-8 | $0.3 \times 10^{-4}$ mol/mol Ag |
| Magenta coupler M-A | 0.30 g |
| Magenta coupler M-B | 0.13 g |
| Colored magenta coupler CM-1 | 0.04 g |
| DIR compound D-3 | 0.004 g |
| High-boiling solvent Oil-2 | 0.35 g |
| Gelatin | 1.0 g |
| Layer 8: Yellow filter layer YC | |
| Yellow colloidal silver | 0.1 g |
| Additive HS-1 | 0.07 g |
| Additive HS-2 | 0.07 g |
| Additive SC-1 | 0.12 g |
| High-boiling solvent Oil-2 | 0.15 g |
| Gelatin | 1.0 g |
| Layer 9: Low-speed blue-sensitive emulsion B-H | |
| Silver iodobromide emulsion (average grain size: 0.3 μm) | 0.22 g |
| Silver iodobromide emulsion (average grain size: 0.4 μm) | 0.25 g |
| Sensitizing dye S-9 | $5.8 \times 10^{-4}$ mol/mol Ag |
| Yellow coupler Y-1 | 0.6 g |
| Yellow coupler Y-2 | 0.32 g |
| DIR compound D-1 | 0.003 g |
| DIR compound D-2 | 0.006 g |
| High-boiling solvent Oil-2 | 0.18 g |
| Gelatin | 1.3 g |
| Layer 10: High-speed blue-sensitive emulsion layer B-H | |
| Silver iodobromide emulsion (average grain size: 0.8 μm) | 0.5 g |
| Sensitizing dye S-10 | $3 \times 10^{-4}$ mol/mol Ag |
| Sensitizing dye S-11 | $1.2 \times 10^{-4}$ mol/mol Ag |
| Yellow coupler Y-1 | 0.18 g |
| Yellow coupler Y-2 | 0.10 g |
| High-boiling solvent Oil-2 | 0.05 g |
| Gelatin | 1.0 g |
| Layer 11: First protective layer PRO-1 | |
| Silver iodobromide (average grain size: 0.08 μm) | 0.3 g |
| UV absorbent UV-1 | 0.07 g |
| UV absorbent UV-2 | 0.10 g |
| Additive HS-1 | 0.2 g |
| Additive HS-2 | 0.1 g |
| High-boiling solvent Oil-1 | 0.07 g |
| High-boiling solvent Oil-3 | 0.07 g |
| Gelatin | 0.8 g |
| Layer 12: Second protective layer PRO-2 | |
| Compound A | 0.038 g |
| Compound B | 0.004 g |
| Polymethyl methacrylate (average particle size: 3 μm) | 0.02 g |
| Copolymer of methyl methacrylate:ethyl methacrylate: methacrylic acid = 3:3:4 (ratio by weight) | 0.13 g |

In addition to the above constituents, the above color light-sensitive material also contains compounds Su-1 and Su-2, viscosity adjusting agent, hardeners H-1 and H-2, stabilizer ST-1, antifoggants AF-1 and AF-2 (having average molecular weights of 10,000 and 100,000, respectively), dyes AI-1 and AI-2, and compounds DI-1 (9.4 mg/$m^2$).

C-1
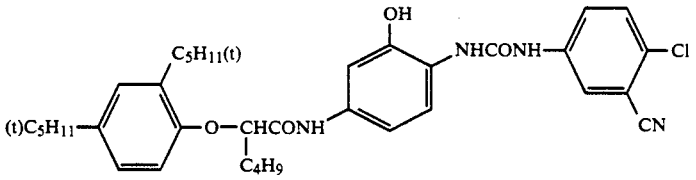
C-2
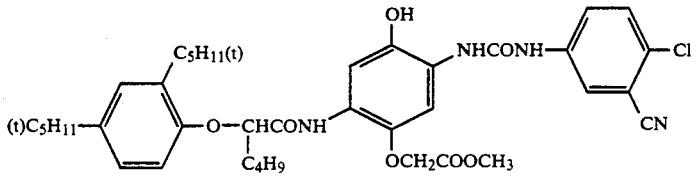
M-A
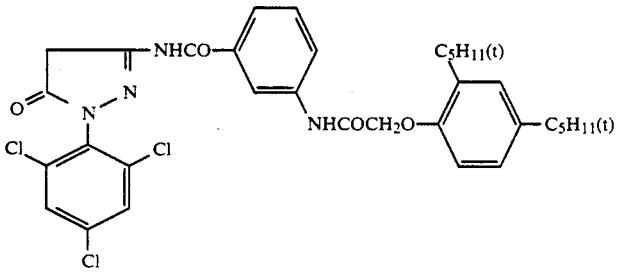
M-B
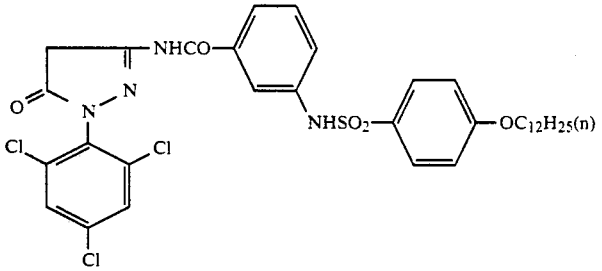
Y-1
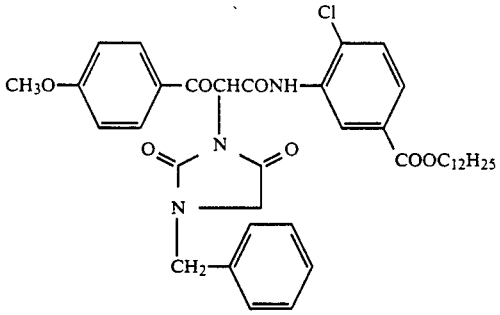
Y-2
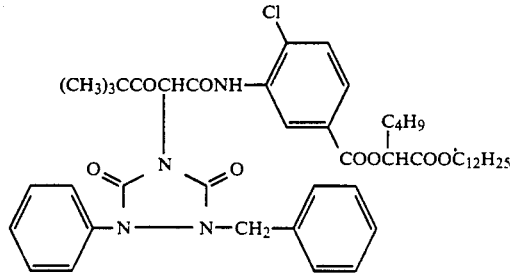

-continued
CC-1
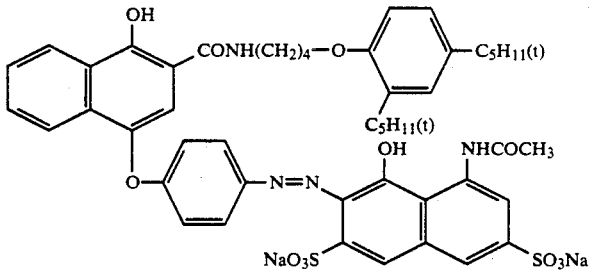
CM-1
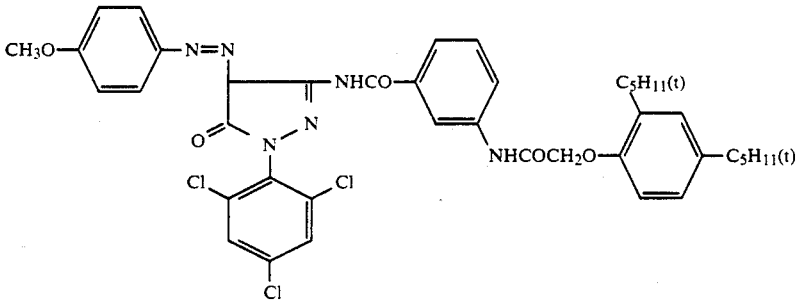
D-1
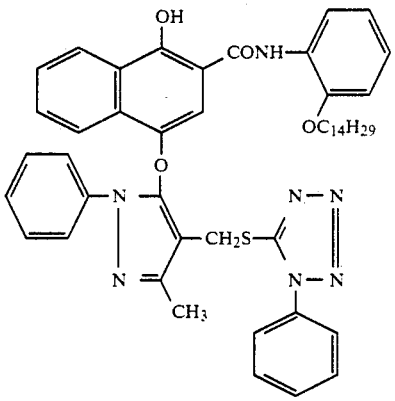
D-2
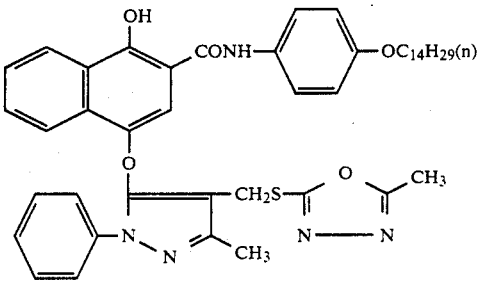

-continued
D-3
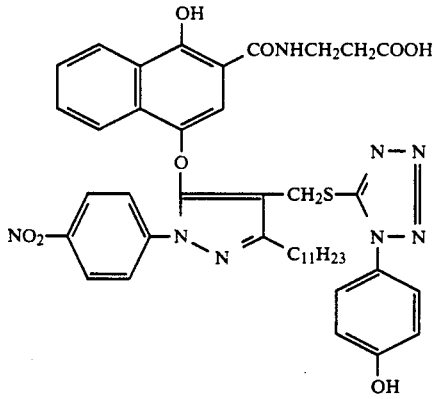
UV-1
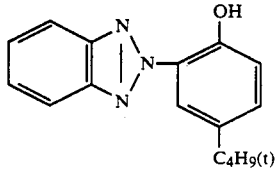
UV-2
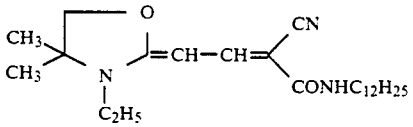
S-1
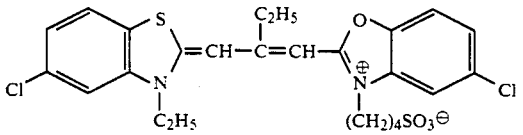
S-2
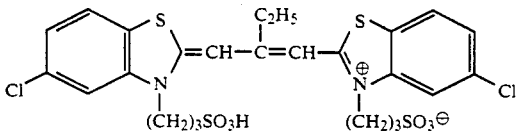
S-3
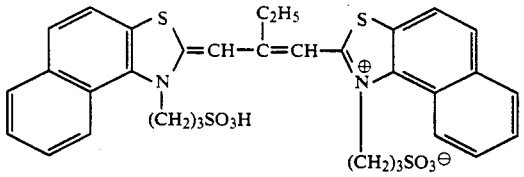
S-4
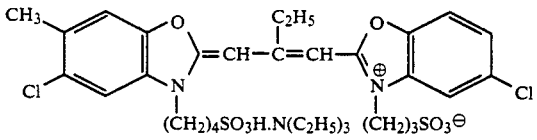
S-5
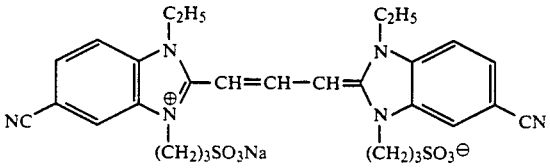

-continued
S-6
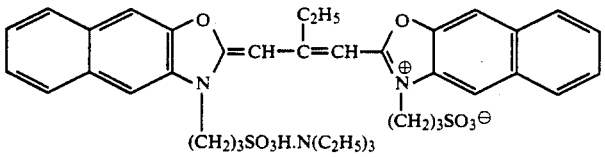
S-7
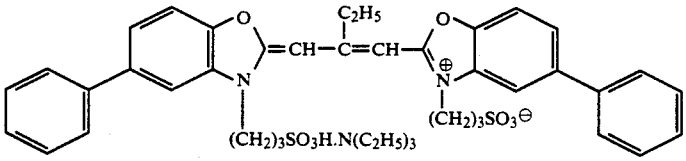
S-8
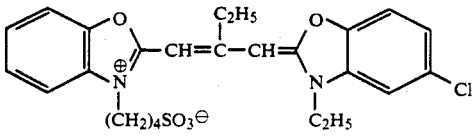
S-9
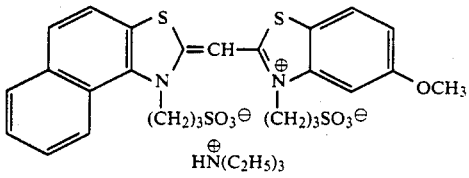
S-10
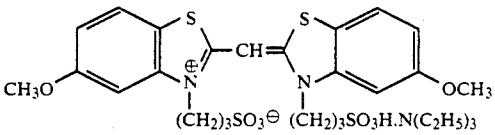
S-11
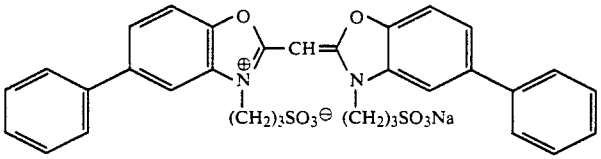
HS-1
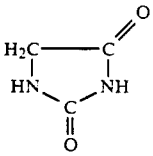
HS-2
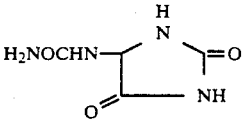
SC-1
A mixture (2:3) of 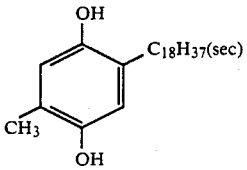 and 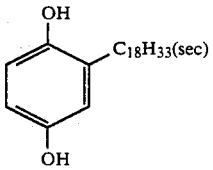
Oil-1
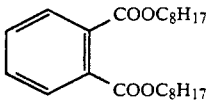

-continued
Oil-2
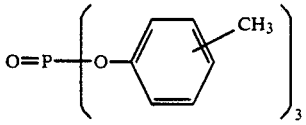
Oil-3
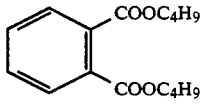
H-1
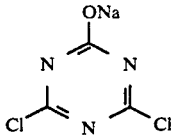
H-2
$(CH_2{=}CHSO_2CH_2)_2O$
SU-1
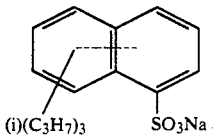
SU-2
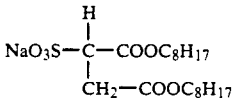
AI-1
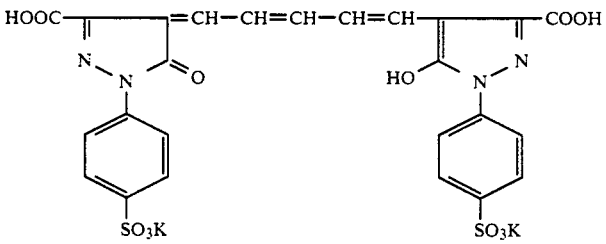
AI-2
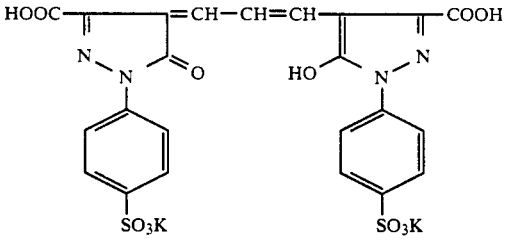
ST-1
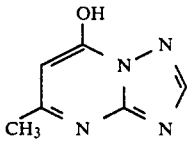
AF-1
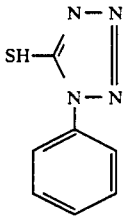

-continued

AF-2

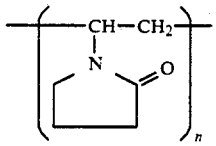

Compound A

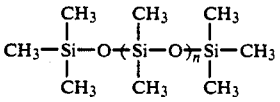

Weight average molecular weight = 30,000

Compound B

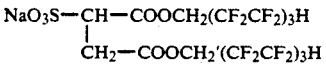

DI-1

A mixture of

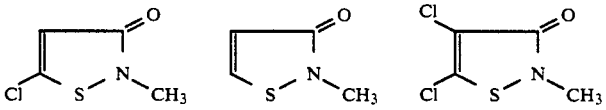

(Constituent A) (Constituent B) and (Constituent C)

A:B:C = 50:23:20 (molar ratio)

Preparation of the Emulsion

The silver iodobromide emulsion for Layer 10 was prepared in the following manner:

Monodisperse silver iodobromide grains having an average grain size of 0.33 μm (containing 2 mol % silver iodide) were used as seed crystals, and a silver iodobromide emulsion was prepared according to a double-jet method.

That is, to the following composition-having Solution G-1 with its temperature, pAg and pH kept at 70° C., 7.8 and 7.0, respectively, with thoroughly stirring, was added a 0.34 mol equivalent amount of the above seed emulsion.

Formation of Internal-High-Iodide Core Phase

After that, the following Solutions H-1 and S-1 in a flow ratio of 1:1 were added spending 86 minutes at an accelerated flow rate (the final flow rate is 3.6 times the initial flow rate).

Formation of External-Low-Iodide Shell Phase

Subsequently, the following Solutions H-2 and S-2 in a flow ratio of 1:1 were added spending 56 minutes at an accelerated flow rate (the final flow rate is 5.2 times the initial flow rate).

The control of pAg and pH during the grain formation were made with an aqueous potassium bromide solution and a 56% aqueous acetic acid solution. The formed grains were washed according to the usual flocculation method, and then gelatin was added thereto for redispersion, and pH and pAg were adjusted at 40° C. to 5.8 and 8.06, respectively.

The obtained emulsion was a monodisperse emulsion comprising 9.0 mol % silver iodide-containing octahedral silver iodobromide grains having an average grain size of 0.80 μm and a grain size variation coefficient ($\sigma/r$) of 12.4%.

| | |
|---|---|
| G-1: | |
| Ossein gelatin | 100.0 g |
| 10 wt % Compound-1 methanol solution | 25.0 ml |
| 28% ammonia water solution | 441.2 ml |

-continued

| | |
|---|---|
| 56% acetic acid solution | 660.0 ml |
| Water to make | 5000.0 ml |
| H-1: | |
| Ossein gelatin | 82.4 g |
| Potassium bromide | 151.6 g |
| Potassium iodide | 90.6 g |
| Water to make | 1030.5 ml |
| S-1: | |
| Silver nitrate | 309.2 g |
| 28% aqueous ammonia solution | Equivalent amount |
| Water to make | 1030.5 ml |
| H-2: | |
| Ossein gelatin | 301.0 g |
| Potassium bromide | 770.0 g |
| Potasium iodide | 33.2 g |
| Water to make | 3776.8 ml |
| S-2: | |
| Silver nitrate | 1133.0 g |
| 28% aqueous ammonia solution | Equivalent amount |
| Water to make | 3776.8 ml |
| Compound 1 | |

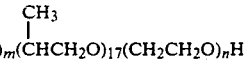

(Average molecular weight ÷ 1300)

The earlier-mentioned respective emulsions different in the silver iodide content were prepared in the same manner except that the seed crystals' average grain size and the temperature, pAg, pH, flow rate, adding time and halide composition of the solutions added were changed.

The obtained in above were core/shell-type monodisperse emulsions each having a grain size distribution width of not more than 20%. Each emulsion was subjected to optimal chemical ripening treatment in the presence of sodium thiosulfate, chloroauric acid and ammonium thiocyanate with the addition of sensitizing dyes, 4-hydroxy-6-methyl-1,3,3a,7-tetrazaindene and 1-phenyl-5-mercaptotetrazole.

Provided that light-sensitive material sample was prepared so that the average silver halide content of the emulsions thereof is 8 mol %.

The above prepared sample was exposed through an optical wedge in the usual manner, and then processed according to the following processing steps.

| Processing step | Time | Temperature |
|---|---|---|
| Color developing | 3 min. 15 sec. | at 38° C. |
| Bleaching | 45 seconds | at 38° C. |
| Fixing | 1 min. 45 sec. | at 38° C. |
| Stabilizing | 90 seconds | at 38° C. |
| Drying | 1 min. | 40 to 70° C. |

Color Developer

| | |
|---|---|
| (Concentrated color developer composition E) | |
| Compound of Formula A, B or C | Amount given in Table 3 |
| Compound of Formula KI, KII or KIII | Amount given in Table 3 |
| Water-soluble surface active agent | Amount given in Table 3 |
| Potassium bromide | 0.4 g |
| Water | 20 ml |
| (Color developer composition F) | |
| 4-Amino-3-methyl-N-ethyl-N-(β-hydroxyethyl)-aniline sulfate | 4.6 g |
| Potassium sulfite | 0.5 g |
| Water | 40 ml |
| (Color developer composition G) | |
| Water | 50 ml |
| Potassium carbonate | 33 g |
| Diethylenetriaminepentaacetic acid | 1 g |
| (Color developer composition H (starter)) | |
| Potassium iodide | 1.2 mg |
| Potassium bromide | 0.9 g |
| Potassium hydrogencarbonate | 2.7 g |
| Water | 10 ml |

After the concentrated color developer composition E was allowed to stand at 50° C. for 60 days, to 800 ml of water, with stirring, were added the color developer compositions E to H, and water was added to make one liter, and pH of it was adjusted to 10.05.

Bleaching Bath

| | |
|---|---|
| Ferric ammonium 1,3-diaminopropanetetraacetate | 0.35 mol |
| Disodium ethylenediaminetetraacetate | 2 g |
| Ammonium bromide | 150 g |
| Glacial acetic acid | 38 ml |
| Ammonium nitrate | 40 g |

-continued

| | |
|---|---|
| Ammonium 1,3-diaminopropanetetraacetate | 2.0 g |
| Water to make 1 liter. | |
| Adjust pH to 4.5 with ammonia water or glacial acetic acid. | |

Fixing Bath

| | |
|---|---|
| Ammonium thiosulfate | 100 g |
| Ammonium thiocyanate | 150 g |
| Anhydroux sodium sulfite | 20 g |
| Sodium metabisulfite | 4.0 g |
| Disodium ethylenediaminetetraacetate | 1.0 g |
| Water to make 700 ml. | |
| Adjust pH to 6.5 with glacial acetic acid or ammonia water. | |

Stabilizing Bath

| Stabilizing bath | |
|---|---|
| Water | 800 ml |
| 1,2-Benzoisothiazoline-3-one | 0.1 g |
| 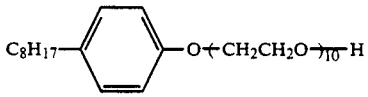 | 2.0 ml |
| Hexamethylenetetramine | 0.2 g |
| Hexahydro-1,3,5-tris(2-hydroxyethyl)-5-triazine | 0.3 g |
| Siloxane L-76, produced by UCC | 0.1 g |
| o-Phenyl-phenol | 0.3 g |
| Ammonium sulfite | 1.0 g |
| Water to make 1 liter. | |
| Adjust pH to 7.0 with potassium hydroxide or 50% sulfuric acid. | |

Dmax G, the maximum green light-transmission density area, of the above-processed light-sensitive material sample was measured with a PDA65 densitometer, manufactured by KONICA Corp.

On the other hand, in respect of the concentrated color developer composition E, the residual amounts of Compounds A, B and C were measured in the same manner as in Experiment 1 of Example 1.

The results of the above experiments are shown in Table 3.

TABLE 3

| Experiment No. | Compound of Formula A, B or C | | Compound of Formula K-I to K-III | | Water-soluble surfactant | | Residual rate (%) of Cpd. Formula A to C | Dmax G |
|---|---|---|---|---|---|---|---|---|
| | Cpd. name | Added amt. | Cpd. name | Added amt. | Cpd. name | Added amt. | | |
| 3.1 (Unaged) | B-23 | 5 g | None* | 0 g | None | 0 g | 100 | 2.0 |
| 3.2 (Comp.) | B-23 | 5 | None* | 0 | None | 0 | 11 | 2.6 |
| 3.3 (Comp.) | B-23 | 5 | None | 0 | None | 0 | 19 | 2.7 |
| 3-4 (Inv.) | B-23 | 5 | K-1 | 5 | None | 0 | 96 | 2.0 |
| 3-5 (Inv.) | B-23 | 5 | K-4 | 5 | None | 0 | 94 | 2.1 |
| 3-6 (Inv.) | B-23 | 5 | K-7 | 5 | None | 0 | 95 | 2.0 |
| 3-7 (Inv.) | B-23 | 5 | K-10 | 5 | None | 0 | 97 | 2.2 |
| 3-8 (Inv.) | C-18 | 5 | K-1 | 5 | None | 0 | 95 | 1.9 |
| 3-9 (Inv.) | C-19 | 5 | K-1 | 5 | None | 0 | 94 | 2.1 |
| 3-10 (Inv.) | C-24 | 5 | K-1 | 5 | None | 0 | 97 | 2.0 |
| 3-11 (Inv.) | C-23 | 5 | K-1 | 5 | S-3 | 0.1 | 96 | 2.1 |
| 3-12 (Inv.) | B-3 | 5 | K-1 | 5 | None | 0 | 98 | 2.0 |
| 3-13 (Inv.) | B-15 | 5 | K-1 | 5 | None | 0 | 98 | 2.0 |

Note:
*5 grams of chelating agent K-1 were added to other color developer composition as in Example 1.

EXAMPLE 6

Storage stability tests were made in the same manner as in Example 1 except that, in the compounds compositions in Experiment No. 1-3 and No. 1-4 of Example 1, the amount of water to be added thereto was varied so as to cause the compound of Formula A, B or C to be in concentrations as given in Table 4.

The results are collectively shown in Table 4.

From Table 4, it is understood that the concentrated compositions of the invention are effective.

TABLE 4

| Experiment No. | Compound of Formula A, B or C Cpd. No. | Compound of Formula A, B or C Added amt. | Compound of Formula K-I to K-III Cpd. No. | Compound of Formula K-I to K-III Added amt. | Water-soluble surfactant Cpd. No. | Water-soluble surfactant Added amt. | Concentration of compound of Formula A, B or C (g/dl) | Residual rate (%) of compound of Formula A, B or C |
|---|---|---|---|---|---|---|---|---|
| 10-1 | B-23 | 5 | None | — | S-2 | 3 | 10.0 | 99 |
| 10-2 | " | " | " | — | " | " | 12.0 | 90 |
| 10-3 | " | " | " | — | " | " | 12.5 | 72 |
| 10-4 | " | " | " | — | " | " | 15.0 | 60 |
| 10-5 | " | " | " | — | " | " | 20.0 | 45 |
| 10-6 | " | " | " | — | " | " | 25.0 | 23 |
| 10-7 | " | " | " | — | " | " | 30.0 | 18 |
| 10-8 | " | " | " | — | " | " | 50.0 | 11 |
| 10-9 | " | " | " | — | " | " | 55.0 | 6 |
| 10-10 | " | " | K-1 | 5 | " | " | 10.0 | 99 |
| 10-11 | " | " | " | " | " | " | 12.0 | 99 |
| 10-12 | " | " | " | " | " | " | 12.5 | 98 |
| 10-13 | " | " | " | " | " | " | 15.0 | 97 |
| 10-14 | " | " | " | " | " | " | 20.0 | 96 |
| 10-15 | " | " | " | " | " | " | 25.0 | 95 |
| 10-16 | " | " | " | " | " | " | 30.0 | 95 |
| 10-17 | " | " | " | " | " | " | 50.0 | 95 |
| 10-18 | " | " | " | " | " | " | 55.0 | 94 |
| 10-19 | B-15 | 5 | " | " | " | " | 10.0 | 99 |
| 10-20 | " | " | " | " | " | " | 12.0 | 99 |
| 10-21 | " | " | " | " | " | " | 12.5 | 97 |
| 10-22 | " | " | " | " | " | " | 15.0 | 96 |
| 10-23 | " | " | " | " | " | " | 20.0 | 95 |
| 10-24 | " | " | " | " | " | " | 25.0 | 94 |
| 10-25 | " | " | " | " | " | " | 30.0 | 94 |
| 10-26 | " | " | " | " | " | " | 50.0 | 94 |
| 10-27 | " | " | " | " | " | " | 55.0 | 93 |

What is claimed is:

1. A concentrated composition of color developer for developing a silver halide color photographic light-sensitive material consisting of (1) a compound represented by Formula B in an amount of not less than 125 g/l, (2) a chelating agent represented by Formula K-II in an amount of from $1\times10^{-4}$ mol/l to 1 mol/l, (3) 3 g of a water-soluble surface active agent, (4) 8 g of ethylene glycol or diethylene glycol, (5) 2 g of a brightening agent, and (6) 20 ml of water; and wherein Formula B is

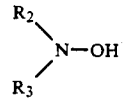

$R_2$ and $R_3$ are each a hydrogen atom or an alkyl group having 1 to 5 carbon atoms which may be substituted with an alkoxy group, a sulfonic acid group, a phosphoric acid group, a carboxyl group or an ammonium group, provided that at least one of $R_2$ and $R_3$ is said substituted or unsubstituted alkyl group, and Formula K-II is

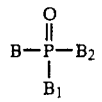

wherein B, $B_1$ and $B_2$ are each a monovalent atom or group.

2. The composition of claim 1 wherein the concentration of said compound of formula B in said composition is 250 g/l to 500 g/l.

3. The composition of claim 1, wherein concentration of said compound of formula K-II in said composition is $5\times10^{-4}$ mol/l to $5\times10^{-2}$ mol/l.

4. The composition of claim 1, wherein said composition has a pH value of not lower than 10.6.

* * * * *